US007121009B2

(12) United States Patent
Robbins et al.

(10) Patent No.: US 7,121,009 B2
(45) Date of Patent: Oct. 17, 2006

(54) CAN OPENER

(75) Inventors: Rodney W. Robbins, Florence, AL (US); Carter W. McGuyer, Muscle Shoals, AL (US)

(73) Assignee: Robbins Industries, Inc., Florence, AL (US)

( * ) Notice: Subject to any disclaimer, the term of this patent is extended or adjusted under 35 U.S.C. 154(b) by 42 days.

(21) Appl. No.: 11/082,418

(22) Filed: Mar. 17, 2005

(65) Prior Publication Data

US 2006/0179669 A1 Aug. 17, 2006

Related U.S. Application Data

(60) Provisional application No. 60/652,486, filed on Feb. 11, 2005.

(51) Int. Cl.
*B67B 7/72* (2006.01)
*B67B 7/46* (2006.01)

(52) U.S. Cl. ..... 30/418; 30/422

(58) Field of Classification Search ..... 30/417, 30/418, 419, 420, 422
See application file for complete search history.

(56) References Cited

U.S. PATENT DOCUMENTS

| | | | | |
|---|---|---|---|---|
| 1,577,880 | A | 3/1926 | Stuart | |
| 1,628,080 | A * | 5/1927 | Leunen | 30/418 |
| D172,235 | S | 5/1954 | Marino | |
| D221,291 | S | 7/1971 | Futter et al. | |
| 3,839,793 | A | 10/1974 | Crapio | |
| 4,207,673 | A | 6/1980 | DiGirolamo et al. | |
| 4,247,216 | A | 1/1981 | Pansini | |
| 4,251,917 | A * | 2/1981 | Peres | 30/403 |
| 4,425,709 | A | 1/1984 | Quenzi | |
| 4,432,137 | A | 2/1984 | Okada | |
| 4,726,119 | A | 2/1988 | Lee | |
| 4,782,594 | A | 11/1988 | Proucznik et al. | |
| 4,825,554 | A | 5/1989 | Koo | |
| 4,941,232 | A | 7/1990 | Decker et al. | |
| 4,953,862 | A | 9/1990 | Uke et al. | |
| 5,181,322 | A | 1/1993 | Koo | |
| 5,291,658 | A * | 3/1994 | Wilson et al. | 30/418 |
| 5,347,720 | A | 9/1994 | Pereira | |
| 5,367,776 | A * | 11/1994 | Chong | 30/417 |
| 5,479,708 | A | 1/1996 | Thomas | |
| 5,535,484 | A | 7/1996 | Gibson | |
| 5,598,634 | A | 2/1997 | Berns | |
| 5,692,309 | A | 12/1997 | Pereira | |
| 5,737,803 | A | 4/1998 | Tisdale | |
| 5,752,968 | A | 5/1998 | Jolly et al. | |
| 5,829,099 | A | 11/1998 | Kopelman et al. | |
| 5,933,918 | A | 8/1999 | Wallays | |
| 5,946,811 | A | 9/1999 | Chang | |
| D420,887 | S | 2/2000 | Chen | |
| 6,115,921 | A | 9/2000 | Garneau, Sr. | |

(Continued)

*Primary Examiner*—Hwei-Siu Payer
(74) *Attorney, Agent, or Firm*—Kramer Levin Naftalis & Frankel LLC; Gregor N. Neff

(57) ABSTRACT

The can opener is a side-cutting opener with handle levers which pivot vertically towards and away from one another. A rotary cutter wheel is normally retracted to a position inside one of said handle levers, but is thrust outwardly to cut into the rim of the can when the handle levers are squeezed together. A drive wheel engages the rim and is rotated by means of a rotary drive handle to cut the top off the can. Spreading the handle levers apart causes the cutting wheel to retract at the end of the cutting operation to release the cut-off top of the can.

6 Claims, 4 Drawing Sheets

U.S. PATENT DOCUMENTS

| | | | | |
|---|---|---|---|---|
| RE37,190 | E | 5/2001 | Stowell et al. | |
| 6,230,366 | B1 | 5/2001 | Lin | |
| D444,029 | S | 6/2001 | Wold et al. | |
| D451,358 | S | 12/2001 | Griese et al. | |
| D452,114 | S | 12/2001 | Lin | |
| 6,829,832 | B1 * | 12/2004 | Chang | 30/417 |

* cited by examiner

CAN OPENER

This invention relates to can openers, and particularly to side-cutting can openers which cut the can lid in a sideways direction, usually through the rim. Priority is claimed from U.S. provisional patent application Ser. No. 60/652,486, filed Feb. 11, 2005.

Side-cutting can openers have a number of advantageous features as compared with can openers which cut through the can lid vertically. By cutting through or near the rim of the can from a sideways direction, the cutting blade does not penetrate into the food in the can and thus helps keep the food in the can free of contamination.

In addition, the can lids often can be replaced on top of the can after it is opened, for the purpose of storage in a refrigerator, etc.

Some prior side-cutting can openers have handles pivoted together which must be squeezed in a horizontal direction towards one another in order to start the cutting of the can lid. This motion is different from that of the normally vertically-moving handles of a vertical cutting can opener to which so many consumers have become accustomed.

Therefore, it is an object of the invention to provide a side-cutting can opener with vertically moving handles in which the handles move towards and away from one another vertically when starting the cutting operation and when removing the can opener after the cut has been completed.

Some prior side-cutting can openers have vertically moving handles, but are relatively complicated and expensive to manufacture.

Therefore, it is another object of the invention to provide a side-cutting can opener with vertically moving handles which is relatively simple, reliable, and inexpensive to manufacture.

In accordance with the present invention, the foregoing objectives are satisfied by providing a side-cutting can opener with handle levers which pivot vertically towards and away from one another, and a rotary cutter wheel which is normally in a retracted position, but is thrust outwardly to cut into the rim of the can when the handle levers are squeezed together. A drive wheel engages the rim and is rotated by means of a rotary drive handle to move the rim past the cutter wheel to cut the top off the can. Spreading the handle levers apart causes the cutting wheel to retract at the end of the cutting operation to release the cut-off top of the can.

Preferably, the cutter wheel is mounted on a carriage which has an angled cam surface. The carriage is mounted to slide in a guideway in one of the handle levers, and a cam projection is positioned on the other of the handle levers to contact the cam surface and drive the carriage into a position at which the cutter wheel cuts into the cam rim.

A set of return springs retracts the carriage when the handle levers are spread apart to disengage the can opener from the can.

The foregoing and other objects and advantages of the invention will be set forth in or apparent from the following description and drawings.

IN THE DRAWINGS

GENERAL DESCRIPTION

Figures 1, 2:
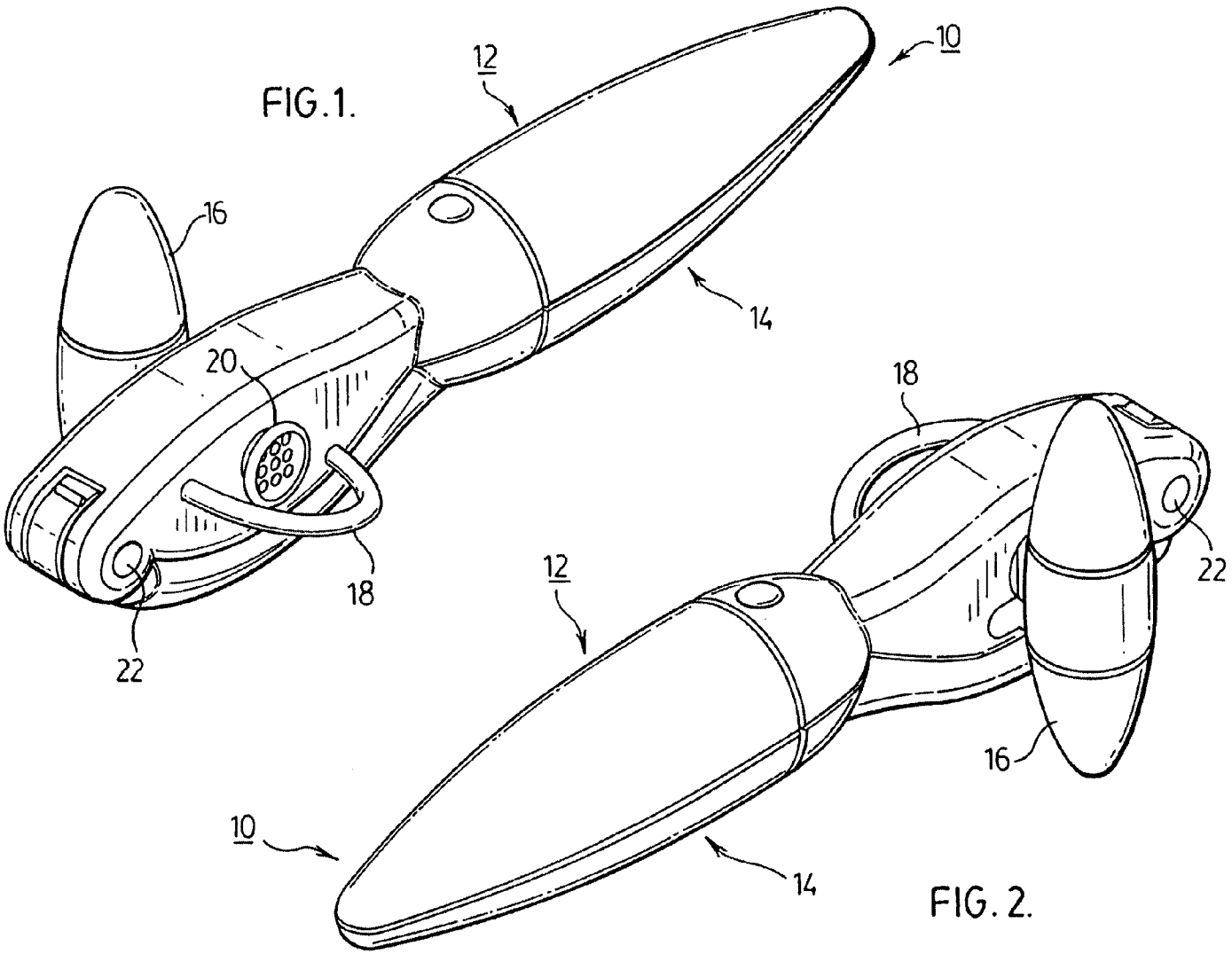
FIG. 1 is a right-side perspective view of a preferred can opener of the invention.
FIG. 2 is a left-side perspective view of the can opener of FIG. 1.

The can opener 10 shown in the drawings has an upper handle lever 12 and a lower handle lever 14 which are pivoted together by means of a pin 22 at one end of each lever.

The can opener has a drive handle 16 for rotating by hand a drive wheel 20 engaged with the rim of the can, and a guide bar 18 to rest on top of the can. The drive wheel moves the rim of the can past a cutting wheel 24 (see FIGS. 3, 4, 5 and 6) which cuts sideways through the rim of the can to remove the top.

Figure 3:
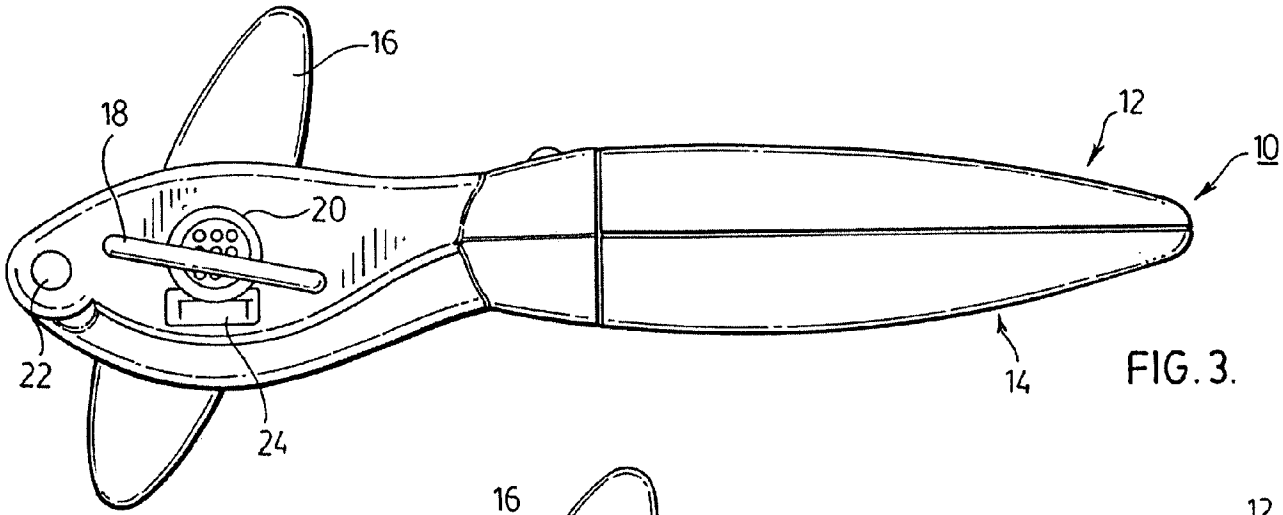
FIG. 3 is a right-side elevation view of the can opener of FIG. 1 with the handle levers in a closed position.
Figure 4:
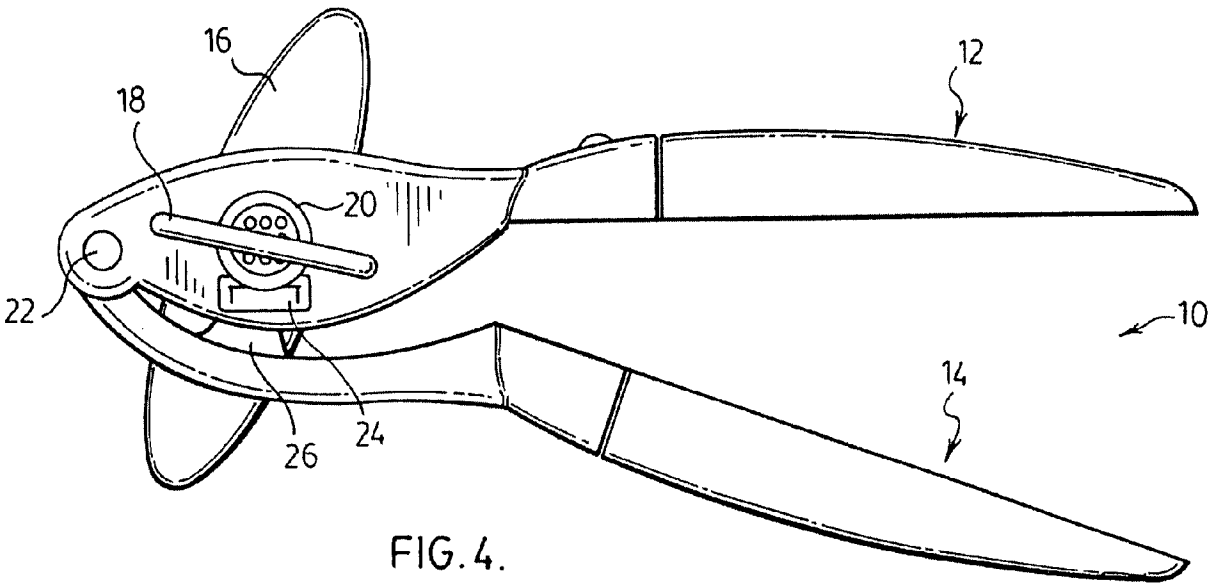
FIG. 4 is a right-side elevation view of the can opener of FIG. 1 with the handle levers separated from one another.

As it is shown in FIGS. 3 and 4, the handle levers 12 and 14 move vertically apart from one another, pivoting about the pin 22.

When the handles are apart, as shown in FIG. 4, a cam member 26 in the form of a projection is disengaged from the cutting wheel 24, and springs (to be described below) within the can opener retract the cutting wheel to allow the can opener to be disengaged from the can rim when the cutting action is finished.

When the handles are squeezed together to the position shown in FIGS. 1, 2 and 3, the projection 26 moves the cutting wheel 24 outwardly from the side of the can opener to cut into the rim of the can to start the cutting operation.

DETAILED DESCRIPTION

Figure 5:
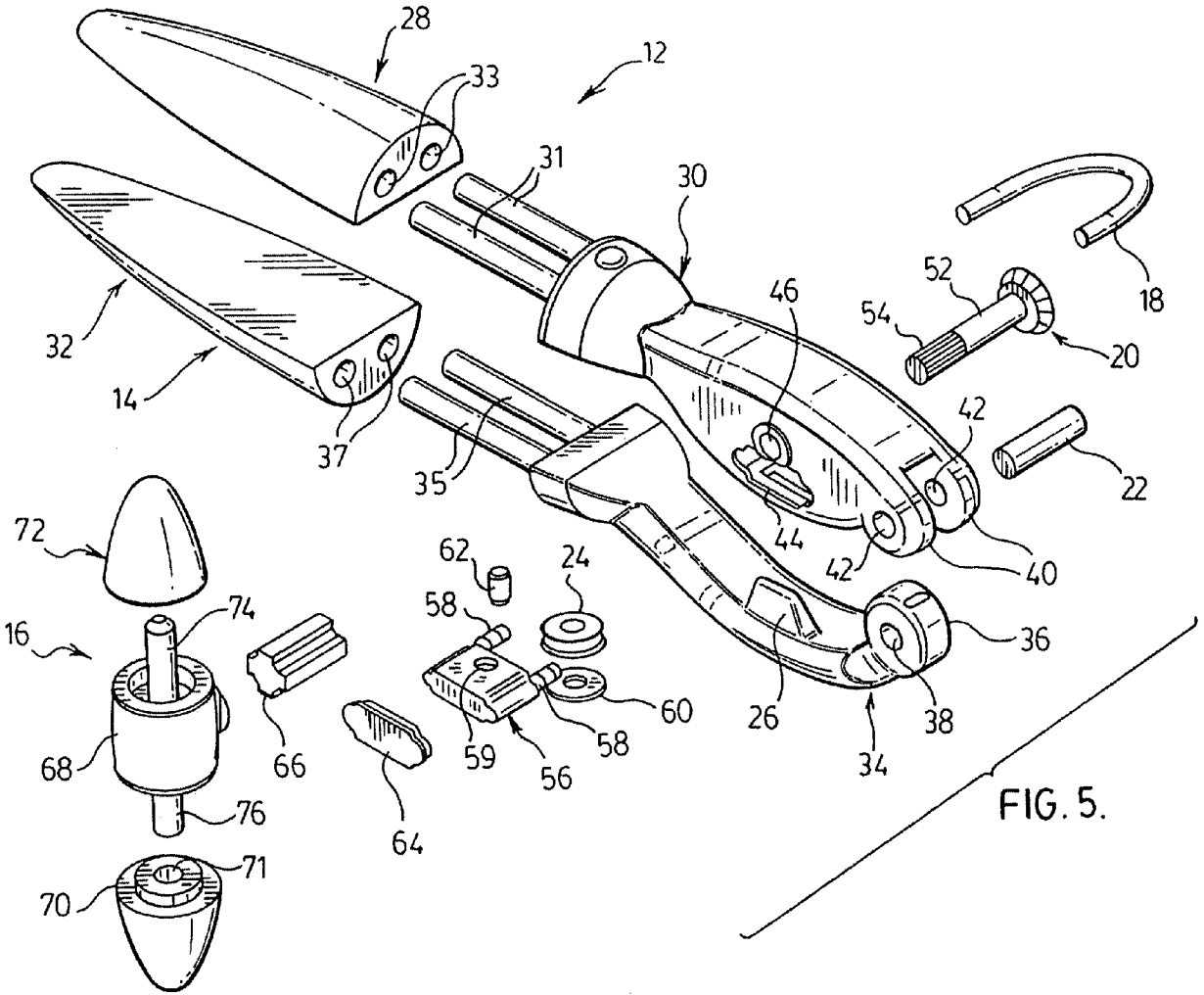
FIG. 5 is an exploded view of the can opener of FIG. 1.

Referring now to FIG. 5, the upper handle lever includes a metal body member 30 with a pair of rods 31 extending from one end and into holes 33 in a wooden handle grip 28.

Similarly, the lower handle lever structure includes a metal body member 34 with a pair of rods 35 extending from one end and into holes 37 in a wooden handle grip 32. The front end of the body 34 has a boss 36 with a hole 38 which mates with holes 42 in the end 40 of the upper body member 30. The pin 22 is press-fitted into the holes 42 and 38 to pivot the two handle levers together.

Figure 9:
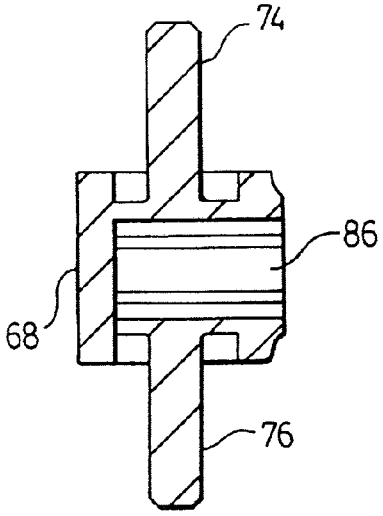
FIG. 9 is a cross-sectional view taken along line 9—9 of FIG. 8.
Figure 8:
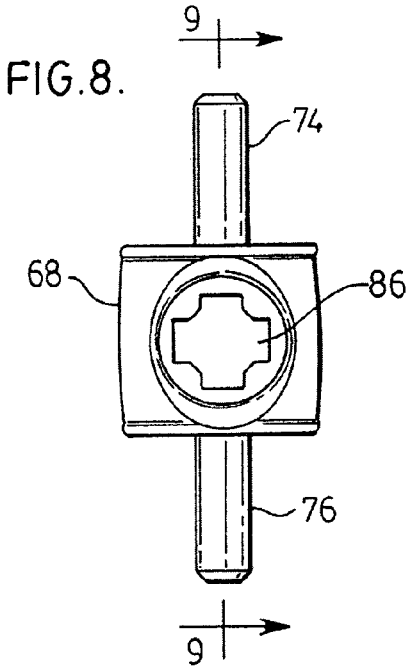
FIG. 8 is a front elevation view of another component of the can opener of FIG. 1.

The drive wheel 20 is mounted at the end of a metal shaft 52 with a knurled end portion 54. The shaft 52 fits through a hole 46 in the body member 30, and the knurled end 54 is press-fitted into a plastic insert member 66 with a hole (not shown). The insert 66 has a cross-shaped cross-section and fits into a mating hole 86 (FIGS. 8 and 9) in a metal drive handle support member 68. The plastic insert 66 is press fitted into the receiving hole 86 in the member 68. The plastic insert 66 is used to prevent breakage in the press-fitting of the metal shaft 52 to the cast metal drive handle support 68.

The drive handle support member 68 has vertically extending pins 74 and 76 which are fitted into holes like the hole 71 in wooden end pieces 70 and 72, thus completing the drive handle structure.

Returning to FIG. 5, the upper body member 30 has a guideway or slot 44 which extends all the way through the body member 30. A carriage 56 is shaped to fit into and slide in the guideway 44.

The carriage 56 has a pair of vertical holes 59 and a pair of holes 78 and 80 (see FIG. 7) into which coil springs 58 are inserted. The cutting wheel 24 is rotatably mounted, with a washer 60, on a shaft 62 which extends into the holes 59. Thus, the cutting wheel 24 is rotatably mounted in the carriage 56.

When the cutting wheel 24 is mounted on the shaft 62 and fitted into the carriage 56, and the springs 58 have been inserted into the holes 78 and 80, the carriage 56 is inserted into the guideway 44 with the springs facing in the direction shown in FIG. 5. The springs are thus positioned to abut against side edges of the body member 30 so as to serve as return springs for retracting the carriage into the housing 30 when the handle levers 12 and 14 are spread apart.

A cover 64 (also see FIG. 6) then is snap-fitted into the entrance opening of the guideway 44 to close it tightly.

Figure 6:
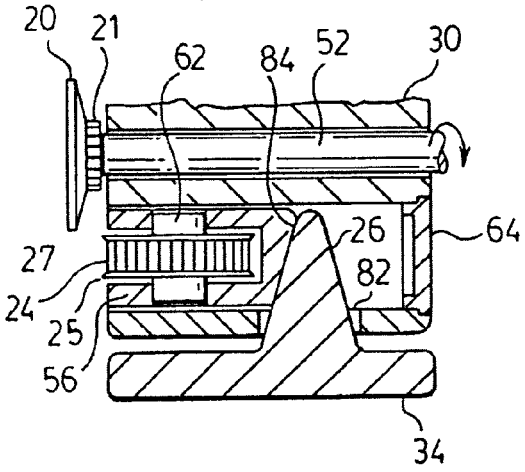
FIG. 6 is a schematic, broken-away cross-sectional view illustrating one of the operational features of the invention.
Figure 7:
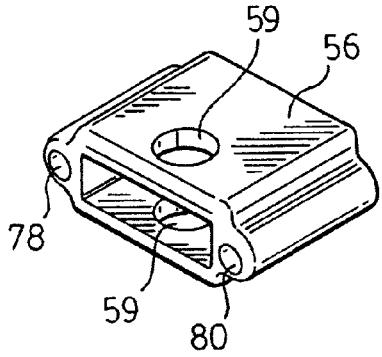
FIG. 7 is an enlarged perspective view of a component of the can opener of FIG. 1.

Now referring particularly to FIGS. 6 and 7, the carriage 56 preferably is molded of a low-friction material such as Delrin so that it will slide with very little friction or wear.

As it is seen in FIG. 6, the carriage 56 has a sloping right cam face 84 whose slope approximately matches the slope on one side of the projection 26. The bottom of the body 30 has a slot 82 through which the projection 26 enters into the guideway and meets with the right face 84 of the carriage and drives it towards the left, as shown in FIG. 6, when the handle levers 12 and 14 are squeezed together.

When the projection 26 is moved downwardly when the handle levers 12 and 14 are moved apart, the springs 58 push the carriage 56 back towards the right as in shown in FIG. 6 to retract the cutting wheel 24 into the body structure 30 so as to release the can rim and the top of the can and disengage the can opener from the can.

The cutting wheel 24, as shown in FIG. 6, has an upper cutting edge 27 which cuts into the can rim, and a lower edge 25 which rides against the side wall of the can and serves as a cutting guide.

The drive wheel 20 has teeth 21 and additional teeth on the right inside surface of the drive wheel to grip the rim of the can and drive it past the cutting wheel 24 when the handle is rotated.

The can opener of the invention thus provides the extremely desirable vertical motion of the two handle levers when moving them towards and away from one another, and yet has a relatively simple construction. The drive wheel shaft advantageously moves in only one direction; that is, a rotary direction. The carriage 56 moves only in a straight line along the guideway under the driving force of the projection 26 which thus serves as a cam.

Although wooden grips or tips for the handle levers 12 and 14 and the drive handle 16 have been described, it should be understood that they have a variety of other constructions. For example, they can be made of all metal, or metal and plastic.

Preferably, the body members 30 and 34 are injection molded of metal. The shafts 22 and 62, and the cutting wheel 24 are made of hardened stainless steel.

The above description of the invention is intended to be illustrative and not limiting. Various changes or modifications in the embodiments described may occur to those skilled in the art. These can be made without departing from the spirit or scope of the invention.

What is claimed is:

1. A side-cutting can opener comprising:

a pair of elongated handle levers pivotably connected together at one end thereof to pivot in a vertical direction relative to each other;

a rotary cutting wheel mounted on a first one of said handle levers to rotate about a vertical axis when cutting, and to move towards one side of said first lever to engage a can rim for cutting, in response to movement of said handle levers vertically towards each other, and to retract away from said one side in response to the movement of said handle levers vertically away from each other;

a drive wheel rotatably mounted on said first handle lever adjacent said cutting wheel to engage said can rim and drive it past said cutting wheel; and a handle drivably connected to said drive wheel for rotating said drive wheel.

2. A can opener as in claim 1 in which said first handle lever has a guideway, a carriage mounted to move along said guideway towards and away from said one side of said first handle lever, said cutting wheel being rotatably mounted on said carriage.

3. A can opener as in claim 2 in which said carriage has a cam surface engageable by a cam for moving said carriage, and the other of said handle levers having a cam positioned to engage said cam surface when said handle levers are moved towards each other to drive said carriage towards said one side of said first handle lever.

4. A side-cutting can opener comprising:

a pair of elongated handle levers pivotably connected to each other at one end thereof to rotate towards and away from each other in a vertical direction to engage and disengage from the rim of a can to be opened while said can is resting on its bottom on a horizontal surface;

a drive wheel on one side of a first one of said handle levers and having a drive shaft rotatably mounted in said first handle lever;

a drive handle on a side opposite said one side of said first lever and drivably coupled to rotate said drive shaft;

a guideway in said first handle lever adjacent said drive shaft;

a carriage mounted in said guideway to move towards and away from said one side of said first lever;

a cutting wheel pivotably mounted on said carriage to rotate in a horizontal plane;

a resilient bias structure for biasing said carriage away from said one side of said first lever;

and a cam structure including a cam element on a second one of said handle levers and positioned to engage said carriage and drive said carriage towards said one side of said first handle lever to thrust said cutting wheel outwardly from said one side to cut into said can rim in a sideways direction when said drive wheel is engaged with said rim.

5. A can opener as in claim 4 in which said cam element is a projection projecting upwardly from said second handle lever, and in which said carriage has a sloping cam follower surface positioned to engage with said projection upon the vertical movement of said handle levers towards each other.

6. A can opener as in claim 4 in which said first handle lever is located vertically above said second handle lever.

* * * * *